US011781848B2

(12) United States Patent
Derode

(10) Patent No.: US 11,781,848 B2
(45) Date of Patent: Oct. 10, 2023

(54) MOBILE DEVICE FOR NEUTRALIZING A CHEMICAL OR BIOLOGICAL WEAPON

(71) Applicant: ARIANEGROUP SAS, Les Mureaux (FR)

(72) Inventor: Thibault Derode, Les Mureaux (FR)

(73) Assignee: ARIANEGROUP SAS, Les Mureaux (FR)

( * ) Notice: Subject to any disclaimer, the term of this patent is extended or adjusted under 35 U.S.C. 154(b) by 0 days.

(21) Appl. No.: 17/756,377

(22) PCT Filed: Nov. 16, 2020

(86) PCT No.: PCT/FR2020/052089
§ 371 (c)(1),
(2) Date: May 24, 2022

(87) PCT Pub. No.: WO2021/105584
PCT Pub. Date: Jun. 3, 2021

(65) Prior Publication Data

US 2022/0412714 A1 Dec. 29, 2022

(30) Foreign Application Priority Data

Nov. 25, 2019 (FR) ..... 1913144

(51) Int. Cl.
*F42D 5/045* (2006.01)

(52) U.S. Cl.
CPC ..... *F42D 5/045* (2013.01)

(58) Field of Classification Search
CPC .. F42D 5/04; F42D 5/045; F42B 33/06; F42B 33/067
See application file for complete search history.

(56) References Cited

U.S. PATENT DOCUMENTS 5,864,767 A * 1/1999 Drumgoole ..... F42D 5/045 86/50
6,359,188 B1 * 3/2002 Parkes ..... F02K 9/96 588/320
6,439,120 B1 * 8/2002 Bureaux ..... F42D 5/045 102/303

(Continued)

FOREIGN PATENT DOCUMENTS

EP 1154821 B1 5/2004
EP 0991449 B1 9/2004

OTHER PUBLICATIONS

International Search Report in International Application No. PCT/FR2020/052089, dated Feb. 16, 2021 (2 pages).

(Continued)

*Primary Examiner* — Joshua E Freeman
(74) *Attorney, Agent, or Firm* — Bookoff McAndrews, PLLC

(57) ABSTRACT

A device for neutralizing a chemical or biological weapon includes a sealed enclosure which delimits an internal volume and which is movable between a retracted position and an extended position, a pyrotechnic neutralizing charge which is disposed inside the enclosure, a decontaminating agent which is disposed inside the enclosure and which surrounds the pyrotechnic neutralizing charge, and a mitigating agent which is disposed in the enclosure and which covers the decontaminating agent.

12 Claims, 3 Drawing Sheets

(56) References Cited

U.S. PATENT DOCUMENTS

| | | | | |
|---|---|---|---|---|
| 7,313,994 | B1 * | 1/2008 | Lacombe | F42D 5/045 102/303 |
| 7,712,405 | B2 * | 5/2010 | Toycen | F42D 5/045 86/50 |
| 7,866,244 | B2 * | 1/2011 | Asahina | F42D 5/04 588/299 |
| 10,184,771 | B2 * | 1/2019 | Bailey | F42D 5/045 |
| 11,592,274 | B2 * | 2/2023 | Heaton | A62D 3/40 |
| 2006/0260459 | A1 * | 11/2006 | Davis | F42D 5/045 86/50 |
| 2007/0039453 | A1 * | 2/2007 | Toycen | F42D 5/045 86/50 |

OTHER PUBLICATIONS

French Search Report in French Patent Application No. 1913144, dated Jul. 15, 2020 (2 pages).

* cited by examiner

MOBILE DEVICE FOR NEUTRALIZING A CHEMICAL OR BIOLOGICAL WEAPON

CROSS-REFERENCE TO RELATED APPLICATIONS

This application is the U.S. national phase entry under 35 U.S.C. § 371 of International Application No. PCT/FR2020/052089, filed on Nov. 16, 2020, which claims priority to French Patent Application No. 1913144, filed on Nov. 25, 2019.

TECHNICAL FIELD

The present invention relates to the general field of neutralizing a weapon and, more particularly, a chemical or biological weapon.

PRIOR ART

Currently, the solutions for neutralizing chemical or biological weapons are heavy industrial tools that cannot be moved.

Thus, the existing neutralization solutions cannot be used in places that are difficult to access or in conflict zones.

Moreover, moving the chemical or biological weapons to the industrial tools in order to neutralize them can encounter difficulties.

DISCLOSURE OF THE INVENTION

The present invention therefore aims to provide a mobile solution making it possible to neutralize a chemical or biological weapon.

The present invention also relates to providing a solution that is simple to use.

According to a first aspect, the invention concerns a device for neutralizing a chemical or biological weapon, characterized in that it comprises:

- a sealed enclosure which delimits an internal volume and is movable between a retracted position and an extended position
- a pyrotechnic neutralizing charge which is disposed inside the enclosure;
- a decontaminating agent which is disposed inside the enclosure and surrounds the pyrotechnic neutralizing charge;
- a mitigating agent which is disposed in the enclosure and covers the decontaminating agent.

According to a possible characteristic, the device comprises a filter which is connected to the internal volume of the enclosure by a channel.

According to a possible characteristic, the device comprises a control system for firing of the pyrotechnic neutralizing charge, the firing control system being connected by a wire to the pyrotechnic neutralizing charge, the wire passing through the channel.

According to a possible characteristic, the device comprises an internal envelope located inside the enclosure and which holds the mitigating agent.

According to a possible characteristic, the mitigating agent is an aqueous foam.

According to a possible characteristic, the enclosure is formed by a flexible envelope.

According to a possible characteristic, the decontaminating agent comprises a powdered solid mineral substance.

According to a possible characteristic, a sarcophagus which comprises a fragile zone surrounds the pyrotechnic neutralizing charge.

According to a possible characteristic, the sarcophagus comprises a chamber closed by a cover, the fragile zone corresponding to the junction between the chamber and the cover.

According to another aspect, the invention concerns a method for using the device according to any one of the preceding characteristics comprising the following steps:

- digging a hole in the ground;
- positioning the enclosure over the previously dug hole;
- pouring a first layer of decontaminating agent into the bottom of the hole;
- positioning a chemical or biological weapon in which the pyrotechnic neutralizing charge is installed inside the enclosure on top of the first layer of decontaminating agent;
- pouring a second layer of decontaminating agent on top of the chemical or biological weapon;
- positioning the mitigating agent inside the enclosure on top of the second layer of decontaminating agent;
- closing the enclosure and putting it in the retracted position;
- firing the pyrotechnic neutralizing charge.

According to a possible characteristic, the second layer of decontaminating agent comprises a first sublayer formed by a mixture of decontaminating agent with a portion of the soil extracted when digging the hole and a second sublayer deposited on the first sublayer and which is formed by the decontaminating agent.

According to a possible characteristic, the chemical or biological weapon and the pyrotechnic neutralizing charge are installed in a sarcophagus which comprises a fragile zone.

BRIEF DESCRIPTION OF THE DRAWINGS

Other characteristics and advantages of the present invention will appear from the description below, in reference to the attached drawings which illustrate a non-limiting example of embodiment thereof.

DESCRIPTION OF EMBODIMENTS

Figure 1:
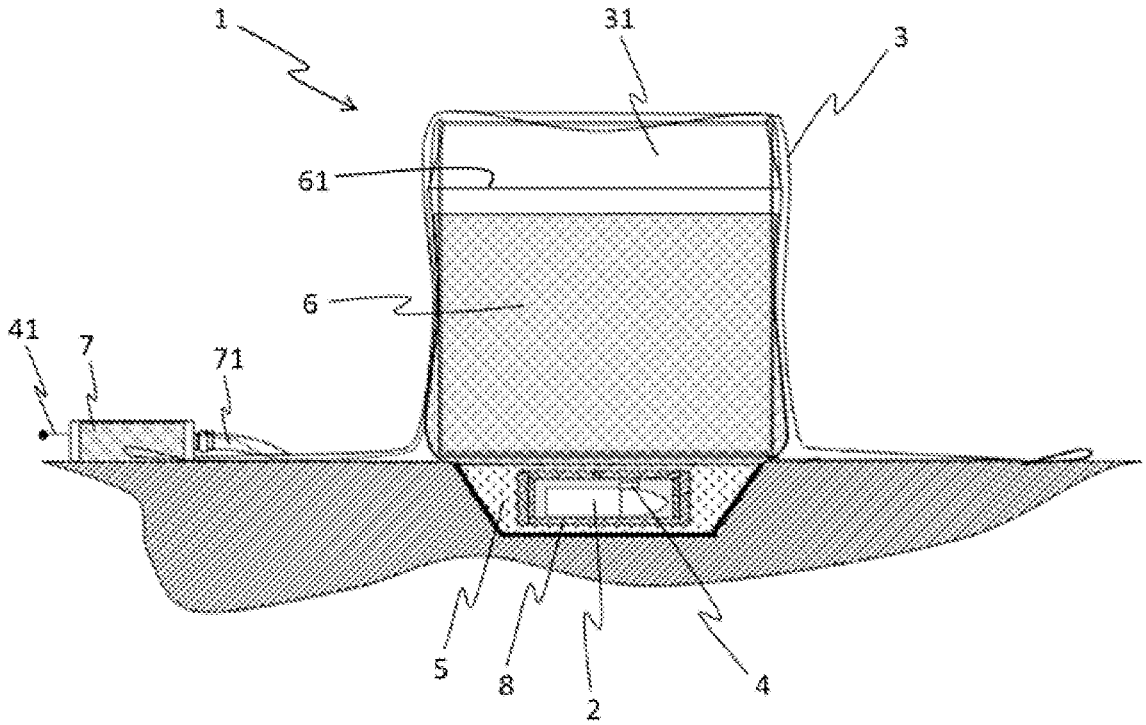
FIG. 1 schematically represents a sectional view of a device according to one possible embodiment of the invention before explosion.

As is illustrated in FIG. 1, a device 1 for neutralizing a chemical or biological weapon 2 comprises an enclosure 3 which is sealed and which delimits an internal volume 31 in which the weapon 2 is placed in order to be neutralized.

When the weapon 2 is a chemical weapon, the weapon 2 can be a chemical munition or even a chemically-charged improvised explosive device. When the weapon 2 is a biological weapon, the weapon 2 can be a biologically-charged munition or even a biologically-charged improvised explosive device.

Figure 2:
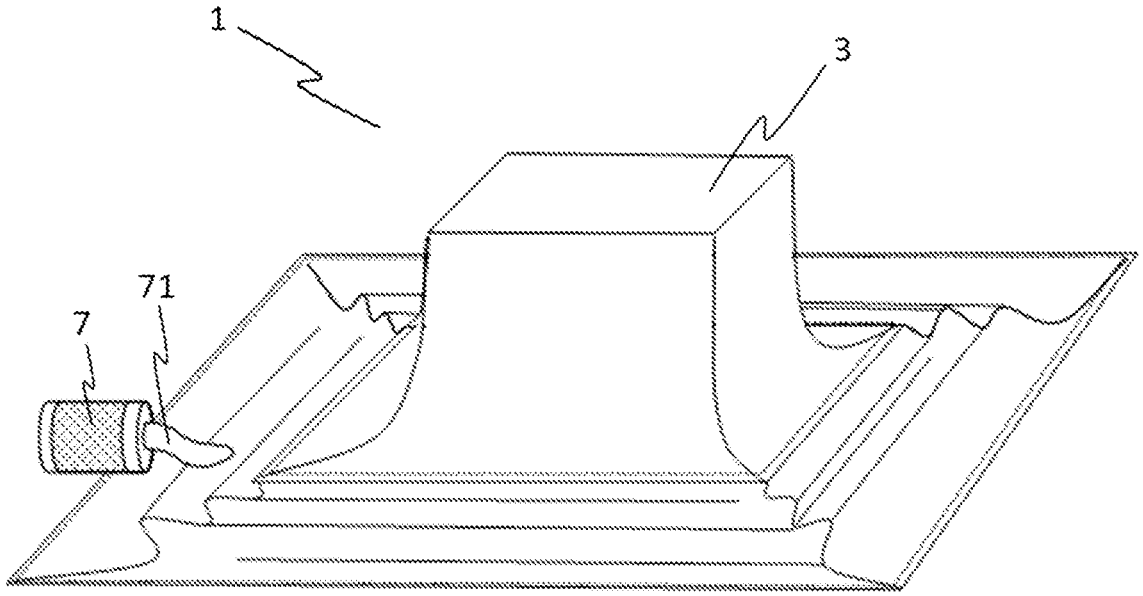
FIG. 2 schematically represents a perspective view of the outside of a device before explosion.
Figure 3:
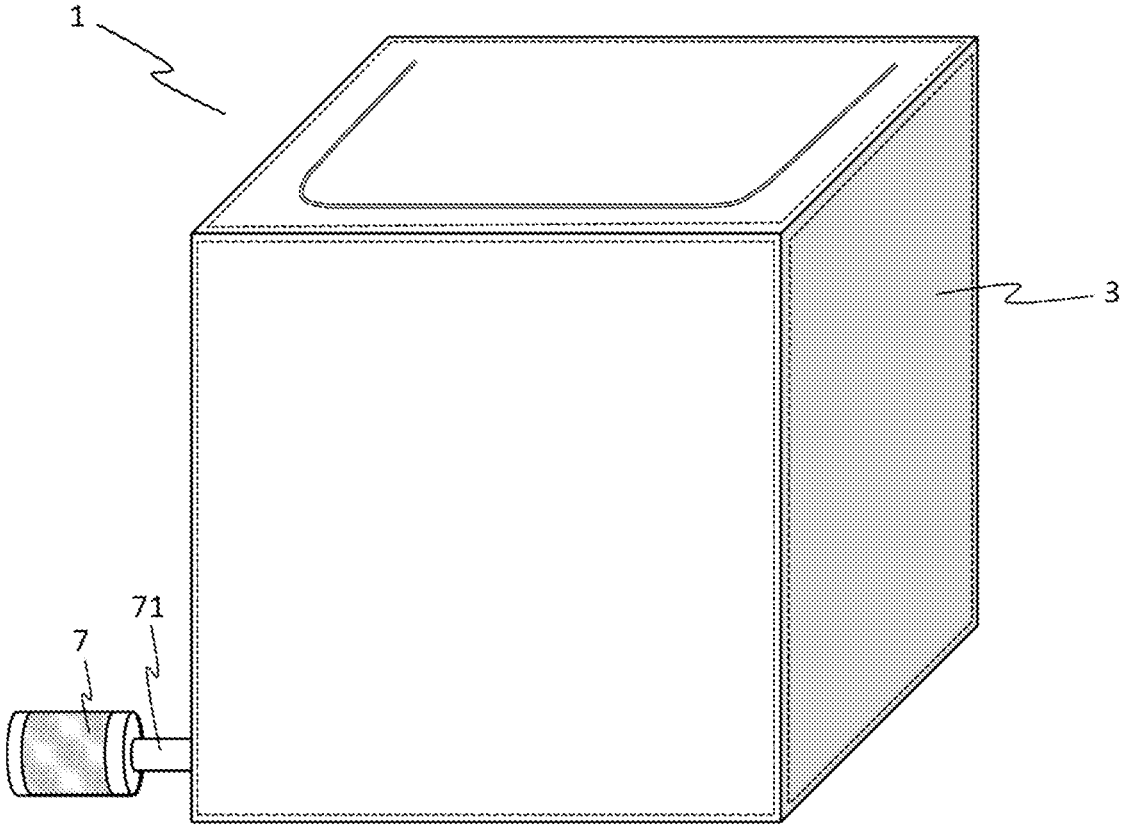
FIG. 3 schematically represents a perspective view of the outside of a device after explosion.

The enclosure 3 is movable between a retracted position (FIG. 2) and an extended position (FIG. 3), the internal volume 31 delimited by the enclosure 3 being larger in the extended position relative to the retracted position.

The enclosure 3 is in retracted position before the explosion and neutralization of the weapon 2 and the enclosure 3 is in the extended position after the explosion and neuralization of the weapon 2. Going from its retracted position to its extended position enables the enclosure 3 to resist the explosion of the weapon 2. Since the weapon 2 is a chemical or biological weapon, the explosive charge is reduced relative to a conventional weapon.

The enclosure 3 is sealed, i.e., it retains gases and liquids, in order to prevent the gases, liquids and dusts that could escape from being released when the weapon 2 is neutralized.

In the example of embodiment illustrated in the figures, the enclosure 3 is formed by a flexible wall, the enclosure 3 going from its retracted position to its extended position under the effect of the explosion of weapon 2.

The enclosure 3 can be of liquid and gas-tight fabric such as CORETECH Shelterguard®, or even Tychem 10000®.

Figure 4:
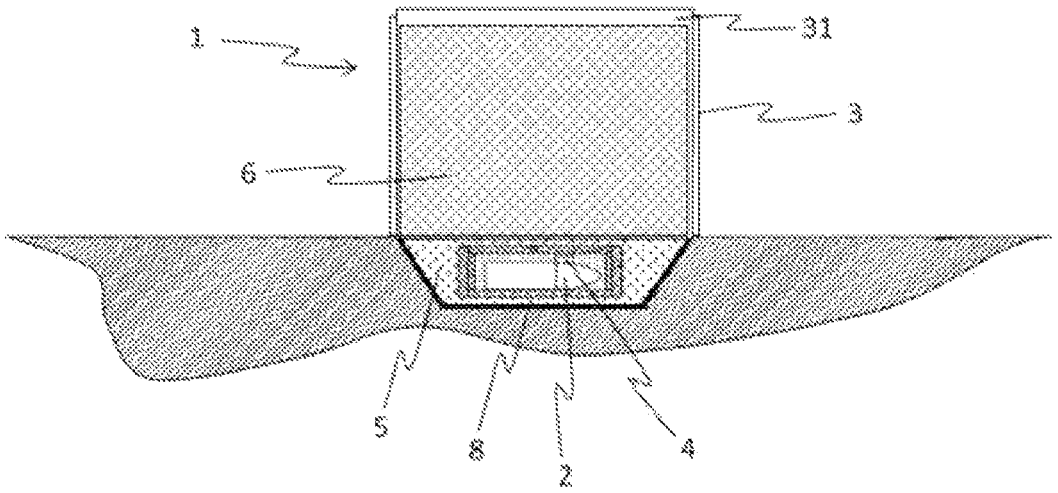
FIG. 4 schematically represents a variant in which enclosure 3 is formed by rigid walls and is in retracted position.
Figure 5:
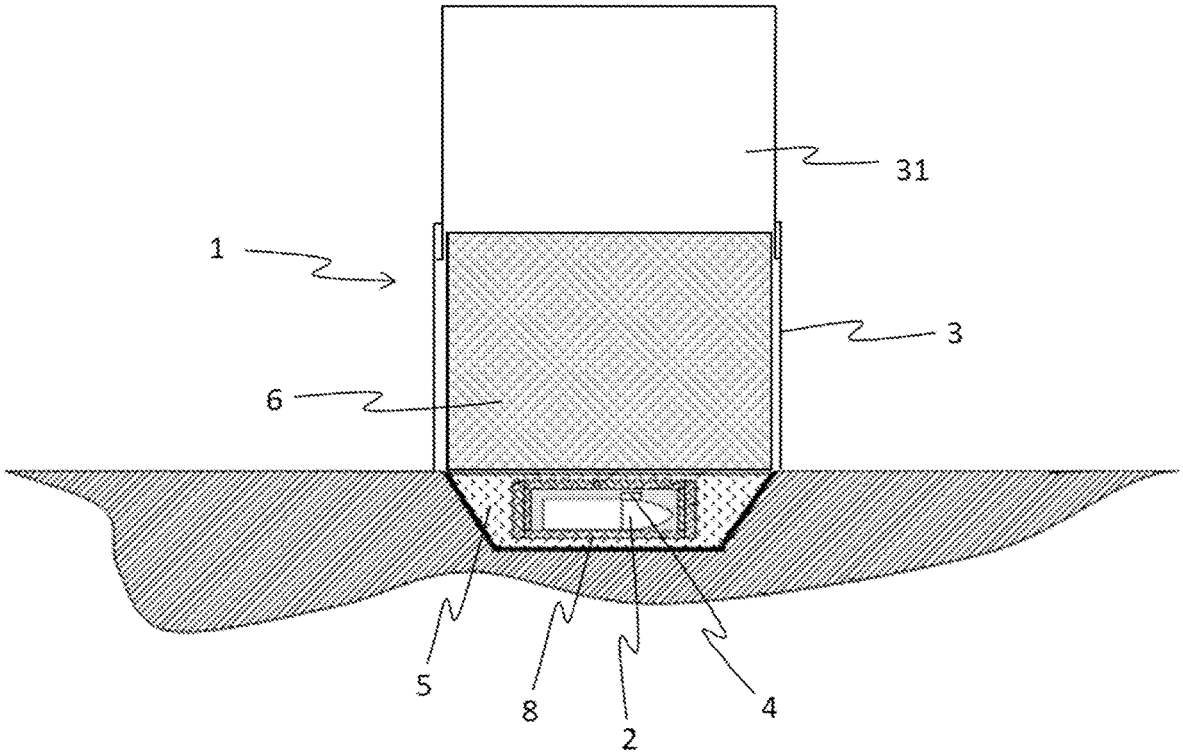
FIG. 5 schematically represents a variant in which enclosure 3 is formed by rigid walls and is in extended position.

According to another possible variant illustrated in FIGS. 4 and 5, the enclosure 3 is formed by rigid walls, for example metal walls, which slide among themselves to ensure extension of the enclosure 3 during the explosion.

According to another possible variant, the enclosure 3 is formed by a flexible wall, for example fabric reinforced by rigid reinforcements, for example metal rods.

The device 1 also comprises a pyrotechnic neutralizing charge 4 which is configured to be installed against the weapon 2 and inside the enclosure 3. The pyrotechnic neutralizing charge 4 functions to initiate the explosion of the weapon 2 in order for said weapon 2 to release the active chemical or biological substance. The pyrotechnic neutralizing charge 4 is adapted according to the chemical or biological weapon 2 to be neutralized.

Device 1 also comprises a decontaminating agent 5 which is disposed inside the enclosure 3 and which surrounds the weapon 2 and the pyrotechnic neutralizing charge 4. The decontaminating agent 5 functions by reacting with the chemical or biological active substance which is released from the weapon 2 when said weapon 1 is exploded. Decontaminating agent 5 is adapted according to the active substance present in the weapon 2. According to a possible variant making it possible to limit liquid effluents and obtain a good tolerance to explosion, the decontaminating agent 5 is a solid mineral decontaminant in the powder form. The decontaminating agent 5 can comprise, for example, calcium hypochlorite, calcium oxide, calcium hydroxide or a mixture of these components.

Device 1 also comprises a mitigating agent 6 which is disposed inside the enclosure 3 and which covers the decontaminating agent 5. Mitigating agent 6 has for a function to absorb a part of the energy released by the explosion of the pyrotechnic neutralizing charge 4 and the weapon 2. The mitigating agent especially makes it possible to greatly reduce the overpressure wave generated by the explosion. The mitigating agent 6 also makes it possible to limit the spread of dust and liquids which especially arise from the toxic loads of the weapon 2.

The mitigating agent 6 can be, for example, an aqueous foam. When mitigating agent 6 is an aqueous foam, or even another fluid material, the device 1 can comprise an inner envelope 61 which is located inside the enclosure 3 and which allows mitigating agent 6 to be retained. The inner envelope 61 can be a flexible wall, which is fabric, for example.

The device 1 for neutralizing the chemical or biological weapon 2 has the advantage of being mobile and therefore can be used at the location where the weapon 2 has been found.

The neutralizing device 1 can be used according to a method that comprises the following steps:

- digging a hole in the ground;
- positioning the enclosure 3 over the previously dug hole;
- pouring a first layer of decontaminating agent 5 into the bottom of the hole;
- positioning the weapon 2 in which the pyrotechnic neutralizing charge 4 is installed inside the enclosure 3 on top of the first layer of the decontaminating agent 5;
- pouring a second layer of the decontaminating agent 5 on top of the weapon 2 and the pyrotechnic neutralizing charge 4, so that the decontaminating agent surrounds the weapon 2 and the pyrotechnic neutralizing charge 4;
- positioning the mitigating agent 6 inside the enclosure 3 on top of the second layer of decontaminating agent 5;
- closing the enclosure 3 and putting it in the retracted position;
- firing the pyrotechnic neutralizing charge 4, thus triggering the explosion of the weapon 2, the explosion causing enclosure 3 to inflate and go into its extended position.

The collection of gas, dust and liquids resulting from the explosion of the weapon 2 are contained in the enclosure 3. The toxic agent contained in the weapon 2 is neutralized by the decontaminating agent 5. The device 1 can then be moved to a final disposal channel, such as an incineration centre, for example.

The decontaminating agent 5 which is disposed around the weapon 2 and the pyrotechnic neutralizing charge 4 can be mixed with a portion of the soil which was removed when digging the hole in the ground. Thus, according to a possible variant, the second layer of decontaminating agent 5 which is poured on top of the weapon 2 comprises a first sublayer formed by a mixture of decontaminating agent 5 with a portion of the soil extracted when digging the hole and, on the other hand, a second sublayer deposited on the first sublayer and which is formed by the decontaminating agent 5.

According to a possible variant making it possible to purge the gas trapped in enclosure 3 after the explosion while preventing the release of harmful species, the device 1 comprises a filter 7 which is connected to the internal volume 31 of the enclosure 3 by a channel 71. The filter 7 can comprise an activated charcoal filter, for example. The filter 7 makes it possible to deflate enclosure 3 in a safe way after firing the neutralization, thus facilitating the transport of the device 1 to the channel for complete disposal.

The device 1 can comprise a firing control system 41 for the pyrotechnic neutralizing charge 4 which is connected to said pyrotechnic neutralizing charge 4 by a wire. According to a possible variant of embodiment, the wire connecting the pyrotechnic neutralizing charge 4 to the firing control system 41 passes through the channel 71.

According to a variant of embodiment allowing the device 1 to increase its resistance to the projection of fragments, the weapon 2 and the pyrotechnic neutralizing charge 4 can be placed inside a sarcophagus 8 whose function is to contain the fragments thrown by the explosion of the weapon 2. The sarcophagus 8 can be made of aramid fibres, for example. In order to prevent too great a pressure increase of the sarcophagus 8, the sarcophagus 8 comprises a fragile zone, so that the sarcophagus 8 breaks through its fragile zone during the neutralizing firing of the weapon 2.

The sarcophagus 8 can comprise a chamber closed by a cover, the fragile zone corresponding to the junction between the chamber and the cover. The chamber can be formed, for example, of a tube which is open at one end, the open end of the tube being closed by a cover. According to another possible embodiment, the tube is open at both ends, the ends each being closed by a cover.

The invention is not limited to the examples presented in the figures; other variants can be used.

The invention claimed is:

1. Device for neutralizing a chemical or biological weapon, wherein it comprises:

a sealed enclosure which delimits an internal volume and is movable between a retracted position and an extended position;

a pyrotechnic neutralizing charge which is disposed inside the enclosure;

a decontaminating agent which is disposed inside the enclosure and surrounds the pyrotechnic neutralizing charge;

a mitigating agent which is disposed in the enclosure and covers the decontaminating agent.

2. Device according to claim 1, wherein the device comprises a filter which is connected to the internal volume of the enclosure by a channel.

3. Device according to claim 2, wherein said device comprises a control system for firing of the pyrotechnic neutralizing charge, the firing control system being connected by a wire to the pyrotechnic neutralizing charge, the wire passing through the channel.

4. Device according to claim 1, wherein device comprises an internal envelope located inside the enclosure and which holds the mitigating agent.

5. Device according to claim 4, wherein the mitigating agent is an aqueous foam.

6. Device according to claim 1, wherein the enclosure is formed by a flexible envelope.

7. Device according to claim 1, wherein the decontaminating agent comprises a powdered solid mineral substance.

8. Device according to claim 1, wherein a sarcophagus which comprises a fragile zone surrounds the pyrotechnic neutralizing charge.

9. Device according to claim 8, wherein the sarcophagus comprises a chamber closed by a cover, the fragile zone corresponding to the junction between the chamber and the cover.

10. Method for using the device according to claim 1, comprising the following steps:

digging a hole in the ground;

positioning the enclosure over the previously dug hole;

pouring a first layer of decontaminating agent into the bottom of the hole;

positioning a chemical or biological weapon in which the pyrotechnic neutralizing charge is installed inside the enclosure on top of the first layer of decontaminating agent;

pouring a second layer of decontaminating agent on top of the chemical or biological weapon;

positioning the mitigating agent inside the enclosure on top of the second layer of decontaminating agent;

closing the enclosure and putting it in the retracted position;

firing the pyrotechnic neutralizing charge.

11. Method according to claim 10, wherein the second layer of decontaminating agent comprises a first sublayer formed by a mixture of decontaminating agent with a portion of the soil extracted when digging the hole and a second sublayer deposited on the first sublayer and which is formed by the decontaminating agent.

12. Method according to claim 10, the chemical or biological weapon and the pyrotechnic neutralizing charge are installed in a sarcophagus which comprises a fragile zone.

* * * * *